US012384580B2

(12) United States Patent
Tattam et al.

(10) Patent No.: US 12,384,580 B2
(45) Date of Patent: Aug. 12, 2025

(54) METHOD OF MANUFACTURE OF A PASSIVE TEMPERATURE CONTROL CARTON FOR TRANSPORT AND STORAGE

(71) Applicant: Softbox Systems Limited, Long Crendon (GB)

(72) Inventors: Edwin Francis Tattam, Long Crendon (GB); Sean James Austerberry, Long Crendon (GB); Jack Walton, Long Crendon (GB); Adam Delderfield, Long Crendon (GB)

(73) Assignee: Softbox Systems Limited, Long Crendon (GB)

( * ) Notice: Subject to any disclaimer, the term of this patent is extended or adjusted under 35 U.S.C. 154(b) by 27 days.

(21) Appl. No.: 18/568,324

(22) PCT Filed: Jun. 10, 2022

(86) PCT No.: PCT/EP2022/025273
§ 371 (c)(1),
(2) Date: Dec. 8, 2023

(87) PCT Pub. No.: WO2022/258228
PCT Pub. Date: Dec. 15, 2022

(65) Prior Publication Data

US 2024/0270423 A1 Aug. 15, 2024

(30) Foreign Application Priority Data

Jun. 10, 2021 (GB) ..... 2108341

(51) Int. Cl.
*B65B 43/08* (2006.01)
*B65B 11/04* (2006.01)
(Continued)

(52) U.S. Cl.
CPC ..... *B65B 43/08* (2013.01); *B65B 11/045* (2013.01); *B65B 11/58* (2013.01); *B65B 55/00* (2013.01); *B65D 81/3813* (2013.01)

(58) Field of Classification Search
CPC ..... B65D 81/3813; B65B 55/00; B65B 11/58; B65B 11/045; B65B 43/08
See application file for complete search history.

(56) References Cited

U.S. PATENT DOCUMENTS 4,972,759 A * 11/1990 Nelson ..... F24H 1/182 220/592.24
5,491,956 A 2/1996 Donnelly et al.
(Continued)

FOREIGN PATENT DOCUMENTS

DE 202014008489 U1 1/2016
WO WO 2007/103267 A2 9/2007
WO WO 2014/126397 A1 8/2014

OTHER PUBLICATIONS

International Search Report and Written Opinion dated Oct. 10, 2022, for International Application No. PCT/EP2022/025273, 11 pages.

*Primary Examiner* — Vishal I Patel
(74) *Attorney, Agent, or Firm* — Frost Brown Todd LLP

(57) ABSTRACT

A method of providing an insulating carton (40) for use in a cubic cold-chain container, the insulating carton (40) being formed of four lateral insulating panels (44) about an axis, together with a base (46) insulating panel arranged orthogonally to the axis, with each insulating panel having four edges, with respective adjacent panel edges mutually abutting, the carton (40) having side walls with mutually orthogonal first and second parallel edges of first and second lengths (LI & L2) with the side panels extending a depth (D) to the base, the panels having a thickness (T); wherein the method comprises the VIP steps of: selecting a cubic former
(Continued)

(50) for the insulating carton, having external dimensions in correspondence with the dimensions of an interior cavity of the insulating carton; placing the panels about the former (50), whereby an inside face of each panel is directed towards a corresponding outside face of the former and an external face of each panel is directed away from the axis; applying adhesive tape (61) about the external faces of the panels, the tape having a width greater than the depth of the side panels; and, folding tape (61) extending from the sides of the towards the base, to secure the side panels to the base, and a system for providing an such a carton.

19 Claims, 10 Drawing Sheets

(51) Int. Cl.

| | |
|---|---|
| ***B65B 11/58*** | (2006.01) |
| ***B65B 55/00*** | (2006.01) |
| ***B65D 81/38*** | (2006.01) |

(56) References Cited

U.S. PATENT DOCUMENTS

| | | | | |
|---|---|---|---|---|
| 6,826,893 | B2 * | 12/2004 | Cere' | B65B 11/025 53/556 |
| 7,861,497 | B2 * | 1/2011 | Lardinois | B65B 11/045 53/399 |
| 7,950,246 | B1 * | 5/2011 | Mayer | F25D 23/063 220/592.25 |
| 2002/0144482 | A1 * | 10/2002 | Henson | E04B 1/803 52/794.1 |
| 2008/0006628 | A1 * | 1/2008 | Goncharko | B65D 81/3816 220/4.33 |
| 2017/0305639 | A1 * | 10/2017 | Kuhn | B65D 43/16 |
| 2018/0334308 | A1 * | 11/2018 | Moore | B65D 65/38 |

* cited by examiner

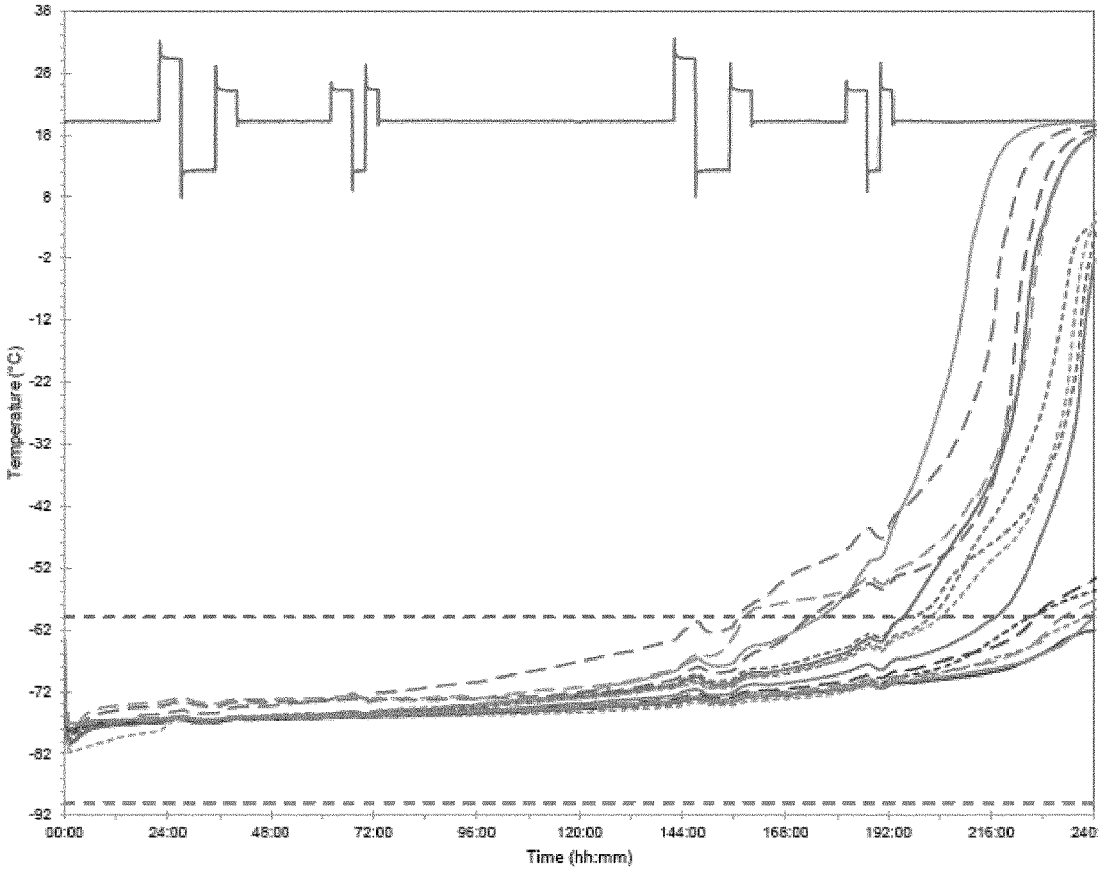

Figure 8d

Air

Standard #1

Standard #2

Standard #3

Standard After Partial Test #1

Standard After Partial Test #2

Standard After Partial Test #3

Standard After Full Test #1

Standard After Full Test #2

Standard After Full Test #3

1st Carton in acc with invention: CIAI.1;
2nd Carton in acc with invention: CIAC.2

CAIC.1 New

CAIC.1 After Partial Test

CAIC.1 After Full Test

CAIC.2 New

CAIC.2 after Partial Test3

CAIC.2 after Full Test

Upper Limit - -60°C

Lower Limit -90°C

Key for Figures 8d & 8e

METHOD OF MANUFACTURE OF A PASSIVE TEMPERATURE CONTROL CARTON FOR TRANSPORT AND STORAGE

This application is a national stage application, filed under 35 U.S.C. § 371, of International App. No. PCT/EP2022/025273, entitled "A method of Manufacture of a Passive Temperature Control Carton for Transport and Storage," filed on Jun. 10, 2022, which claims priority to and the filing benefit of GB2108341.5, entitled "A Method of Manufacture of a Passive Temperature Control Carbon for Transport and Storage," filed on Jun. 10, 2021.

FIELD OF INVENTION

The present invention relates to the field of the transportation and storage of goods and to a passive temperature control system for such transport and storage cartons. The present invention also relates to the field of a manufacturing assembly for cold chain cartons and box-type containers.

BACKGROUND TO THE INVENTION

In the field of logistics, that is the field of movement and supply of produce and materials, there is a substantial requirement for the provision of a temperature control system to ensure that certain types of produce and materials do not pass through temperature thresholds. It is well known that, for example, vegetables when subject to extremes of temperature that they become flaccid, as the cell structure is broken down through the formation of icicles or through dehydration. Similarly, in the transport of drugs and vaccines and certain other chemicals, a solution may separate or become solid. It will also be appreciated that even relatively small amounts of pharmaceutical product can cost thousands of pounds or more; temperature deviations from an allowed temperature can become very expensive; such goods typically having journey temperature plotting indicators, whereby any temperature deviation means that product is discarded and destroyed, irrespective of the cost of the product.

In essence, in any transport container with a thermally sensitive load, the rate at which heat passes through the packaging material of the transport container—the amount of heat that flows per unit time through a unit area with a temperature gradient per unit distance must not extend beyond a permitted temperature range for the product. Temperature control of thermally sensitive goods is particularly challenging when the thermally sensitive goods must be maintained within a narrow temperature range, irrespective of the ambient temperature—from, for example, a tropical runway at 30° C. to −40±20° C. outside air temperature for an aircraft at a service ceiling of the aircraft at 42,000 feet; whilst the temperature of the hold will be greater, it will nonetheless be susceptible of getting quite cold.

Typical means for shipping temperature sensitive materials involves the use of an insulated box, with the necessary shipping and warning labels, along with some cooling agent. These cooling agents have typically been, for example, a frozen gel, dry ice, or wet ice, placed within an insulator packing agent, such as cotton or, latterly, plastics materials such as expanded polystyrene foam, wherein heat is absorbed by such cooling agents.

Multilayer insulation (MLI) is the most common passive thermal control element used in transport. MLI seeks to prevent both heat losses to the environment and excessive heating from the environment. Low cost temperature control in the transport industry relies upon MLI to retain an inside temperature subject to the thermal path to a transported product from an outside the outside to maintain ideal operating temperature. MLI can simply comprise layers of plastics foam; more complex MLI can consist of an outer cover layer, an interior layer, and an inner cover layer. Some common materials used to the outer layer are fiberglass woven cloth impregnated with PTFE Teflon, PVF reinforced with Nomex bonded with polyester adhesive, and FEP Teflon. The general requirement for interior layer is that it needs to have a low emittance. The most commonly used material for this layer is Mylar that is aluminized on both or one side. The interiors layers can be thin compared to the outer layer to save weight.

There is an increasing use of vacuum insulation panels (VIP), which have been developed for use in the manufacture of the walls of refrigerators and freezer and for transport containers and insulated shipping cartons, ice storage tanks, etc. A vacuum insulated panel (VIP) comprises a special composite made of core materials surrounded by an external impermeable, protective sleeve. The core materials comprise highly-porous materials, such as fumed silica, aerogel, perlite, or glass fibre. These core materials are rigid to space and support the sleeves from imploding due to atmospheric pressure once the air is evacuated. The vacuum insulation, provided with getters to associate and absorb any gasses that may have leaked through or have off-gassed from the protective sleeve, effectively prevent convective heat transfer to perfect its thermal insulation. Membrane walls, used to prevent air from entering the panel. The vacuum is considerable and can be as strong as 1 mbar, which make the panels susceptible to damage. VIPs are vulnerable during manufacture, transport, and fabrication, during applications and in use since the barrier film is very easily punctured. A simple puncture will immediately reduce the insulation value of the panel to no better than a PU foam.

With a thermal conductivity of as low as 0.0015 w/m·K to 0.0025 W/m·K, the thermal resistance of vacuum insulation panels can be approximately ten times higher than those conventional insulation materials. Through increasing the degree-of-vacuum of vacuum insulated panel to the limit, these thermal insulation products provide a high-performance insulation such that energy is saved in not maintaining active cooling systems etc. Vacuum insulated panels support the trend of CFC-free thermal insulation. The thermal resistance per unit price is much less than conventional materials: VIPs are more difficult to manufacture than polyurethane foams or mineral wools, and strict quality control of manufacture of the membranes and sealing joins is important if a panel is to maintain its vacuum over a long period of time. Air will gradually enter the panel, and as the pressure of the panel normalizes with its surrounding air its R-value deteriorates. Conventional insulation does not depend on the evacuation of air for its thermal performance, and is therefore not susceptible to this form of deterioration. Nonetheless, vacuum insulation panels are increasingly being used in ultra low temperature containers and cartons for medical products such as medicines, vaccines and the like, where the temperature is maintained at the sublimation temperature of dry ice.

Dry ice is a solid form of carbon dioxide. Its advantages include an ability to reduce a temperature of a body significantly lower than that of water ice and in not leaving any residue (other than incidental frost from atmospheric moisture). It is useful for preserving frozen foods where mechanical cooling is unavailable. Dry ice sublimates at 194.65K (−78.5° C.; −109° F.) under normal atmospheric pressures. This extreme cold makes the solid dangerous to handle without protection due to burns caused by freezing (frostbite). Additionally, although not particularly toxic per se, the outgassing from dry ice as used in packaging can cause operatives involved in cold chain delivery procedures to suffer from hypercapnia (abnormally elevated carbon dioxide levels in the blood) due to build-up in confined locations. There are, however, additional problems when used in packaging which are exacerbated by this outgassing: the gaseous pressure within a container increases. Carbon dioxide is a cheap, inert, non-toxic and easy to liquefy. Although it is deadly in highly concentrated amounts, this characteristic can assist in the prevention of the multiplication of microbes in a carton or package. It will be appreciated that this pressure will be greater than an external atmospheric pressure and so any gaps between adjacent panels will be prised further open by the gas as it seeks to gain equivalence in pressure with the external atmosphere. Further, given that dry ice shipments give rise to the evolution of carbon dioxide gas during shipment it is widely considered as being so dangerous to shipping personnel that hazard warnings must be posted and additional fees are required to be paid; indeed, outright bans on dry ice are pending in several areas. With reference to FIG. 1, there is shown a graph of phase diagrams of carbon dioxide (red) and water (blue) showing the carbon dioxide sublimation point (middle-left) at 1 atmosphere. As dry ice is heated, it crosses this point along the bold horizontal line from the solid phase directly into the gaseous phase. Water, on the other hand, passes through a liquid phase at 1 atmosphere. As a rule of thumb, for a carton expect a half kilogramme of dry ice to sublimate every 24 hours. However, the exact sublimation rate will depend on the quality of the insulation provided. The lower the level of insulation, the faster the rate of sublimation—and this is factored into any determination in the amounts of dry ice that are required for a duration of transport and storage, taking into account the varying needs of the goods, whether they be placed outside on a ground support vehicle on, for example, Miami airport on a summer's day or in the hold of an aircraft thousands of metres in the sky.

Blood, meaning transfusion blood, must be maintained within a close temperature range of between +1° C. and +6° C. during its passage between donor and receiver. Various biological products, such as platelets, whole blood, semen, organs and tissue, must be maintained above a predetermined minimum temperature and below a predetermined maximum temperature. Pharmaceutical products are also commonly required to be kept within a specified temperature range. Food products, flowers and produce frequently have preferred storage temperature ranges as well. Indeed, certain types of goods have stringent standards to be adhered to. For example, as part of a World Health Organisation (WHO) pre-qualification scheme, vaccine manufacturers are expected to ensure their packaging complies with the criteria as determined in one of three classes of packaging: Class A packaging; Class B packaging; and, Class C packaging.

Numerous insulated shipping containers have been developed over the years, with those deploying a phase change material (PCM) generally providing superior temperature control over extended periods. Insulated shipping containers employing a PCM can be deployed for a wide range of thermally sensitive goods over a wide range of target temperatures by using different PCMs. For example, D2O melts at +4° C., H2O melts at 0° C., a 20% ethylene glycol solution melts at −8° C., castor oil melts at −10° C., neat ethylene glycol melts at −12.9° C., mineral oil melts at −30° C., and a 50% ethylene glycol solution melts at −37° C. This permits use of insulated shipping containers for a broad range of thermally labile goods.

Presently, there are few containers for ultra low temperature distribution: FIG. 2*a* shows a trolley bin which, whilst providing a good volume for large items, the trolley bin is oversize for vials as are commonly employed in medical supplies and vaccines, the trolley bin has no easily assembled configuration for product, the trolley bin cannot be flat-packed and present a large "dead" volume when not employed. FIG. 2*b* shows a sidewall entry system polypropylene container but, akin with the trolley bin of FIG. 2*a*, present problems on temperature monitoring and secure placement of a load. FIG. 3*a* shows a carton wherein an EPS container 31 is placed within a cardboard box 30. An absorbent material 32 and an insulation buffer pad 33 lie below a product 34—in this case a food product. Above the product, an insulation buffer pad 33, to isolate the product from direct contact with the dry ice, is provided prior to placement by dry ice 36—shown as being introduced by a nozzle 37 element connected to a dry ice supply, with a further absorbent pad 33 being provided to underlie a complementary EPS lid 38 of the container. Once in place, the lid is in place, the cover flaps 39 of the carton are then sealed. This system has loose dry ice which cannot be prevented from getting into contact with product. FIG. 3*b* shows another form of expanded polystyrene temperature control carton where samples are maintained sandwiched between a buffer insulation layer and an outer ice pack. It will be noted that this form of temperature control, whilst compact does not necessarily permit ultra low temperatures to be maintained and positioning of temperature probes will be difficult, with ensuing compliance issues. Card and cardboard panels when manufactured to provide a high degree of rigidity, through the use of waterproofing and other agents and multi-layer cardboard and corrugated cardboard including multi-layer corrugated board such as triwall corrugated cardboard can prove to be difficult to fold, causing breakage of the board leading to the creation of cracks and fissures leading to air passages in the material, leading to gas flow therefrom and thus making such containers less useful, especially in cold chain transport applications.

It is important to note that the typical value of medicines, vaccines etc. is high; if there has been a temperature excursion out of a required temperature range, then transport protocol demands that the goods are discarded given that the effects of a potentially thermally damaged medicine cannot be permitted to be utilized. All thermally labile products when transported will have temperature data logging equipment which will ensure that only properly stored goods will be used. The failure of any transport container for such goods is unacceptable. It will be realized that any failure will necessitate a repeat delivery, doubling the cost of what may so easily be an extremely valuable product, which may also delay treatment of patients in hospitals and elsewhere, often in time-critical situations, as is being borne out during the C-19 pandemic of present times.

Object of the Invention

The present invention seeks to provide a solution to the problems addressed above. The present invention seeks to provide a simple system for the manufacture of a sealed insulation panel arrangement for placement within a temperature controlled transport container or carton. The present invention also seeks to provide a temperature controlled transport/storage assembly for goods palletised or otherwise, whereby goods can be maintained within an atmosphere having a predefined temperature range. The present invention also seeks to provide a sealed insulation panel arrangement that is constructed such that it can be maintained and panels thereof be replaced in a simple and reliable fashion.

Statement of Invention

In accordance with a general aspect of the invention, there is provided a method of providing an insulating carton for use in a rectangular/cubic cold-chain container, the insulating carton being formed of four side insulating panels about an axis, together with a base insulating panel arranged orthogonally to the axis, with each insulating panel having four edges, with respective adjacent panel edges mutually abutting, the carton having side walls with mutually orthogonal first and second parallel edges having first and second lengths (L1 & L2) with the side panels extending a depth D to the base, the panels having a thickness T; wherein the method comprises the steps of: Selecting a cubic former for the insulating carton, having external dimensions in correspondence with the dimensions of an interior cavity of the insulating carton; Placing the panels about the former, whereby an inside face of each panel is directed towards a corresponding outside face of the former and an external face of each panel is directed away from the axis; Applying adhesive tape about the external faces of the panels, the tape having a width greater than the depth of the carton; and, folding tape extending from the sides of the towards the base, to secure the side panels to the base. Conveniently the tape extends from an open end of the container about an edge of the side panels and this is folded or wrapped over the edge. Conveniently the mandrel is arranged for rotation about an axis in correspondence with a central axis of the carton. In practice, the tape could be formed by two or more tapes which overlap to a degree, but are applied at the same time whereby, for example, different width tapes can be utilized to cope with different height panels, without creating significant manufacturing problems. It will be appreciated that the base panel could be arranged so as to fit inside the inside faces of the wall panels; equally the base panel could be arranged to abut the lower edges of the wall panels.

The insulation panels are preferably selected from one of the following types: Vacuum insulation panels, expanded polystyrene panels, polyurethane panels, card, plastics card, corrugated plastics, cardboard and corrugated cardboard panels. Conveniently, the mandrel is provided with tack strips such that it permits the application of a further tape which is applied to the former prior to the placement of insulation panels, whereby the adhesive tape can be applied an inside surface of the carton. The base is generally rectangular; in the event that the base is square, then the first and second lengths (L1 and L2) will be the same. Card and cardboard panels when manufactured to provide a high degree of rigidity, through the use of waterproofing and other agents and multi-layer cardboard and corrugated cardboard including multi-layer corrugated board such as tri-wall corrugated cardboard can prove to be difficult to fold, causing breakage of the board leading to the creation of cracks and fissures in the material leading to passage of gases therethrough.

Conveniently the fabrication process can be performed—at least in part—following damage suffered to one or more panels, whereby cartons that have been damaged in use can have their one or more damaged panels replaced, thereby reducing waste by not necessitating the replacement of the whole carton. It has been found that by the use of low tack adhesives, the tape can be easily removed, without providing a significant inconvenience. The present invention also provides a fabrication system including a mandrel operable to retain two or more thermally insulating panels about an axis and to maintain the mandrel in a position to receive a plastics film, to enable the adhesive tape or film to be wrapped about the panels whereby to enable the film to secure the panels one with respect to the other whereby to define an open container to be closed by a further panel and placed within a cold chain carton.

In accordance with a general aspect of the invention, there is provided a temperature controlled transport/storage container for transporting/storing temperature sensitive materials the container comprising a receptacle therewithin, wherein the receptacle comprises: a number of thermally insulating panels retained by an adhesive plastics film about an outside of the container. In use the container is closed by a closure panel or lid having similar thermal insulating properties.

The present invention also provides a fabrication system including a mandrel operable to retain two or more thermally insulating panels about an axis and to maintain the mandrel in a position to receive a plastics film, to enable the plastics film to be wrapped about the panels whereby to enable the film to secure the panels one with respect to the other whereby to define an open container to be closed by a further panel and placed within a cold chain carton.

The temperature control panels can be configured to provide a thermally stable atmosphere within a payload volume for a number of days as is typical for international travel, for example. The present invention can, by the use of specially adapted thermal modelling software, be optimised for particular goods for specific transport and storage time with respect to a specific situation.

The present invention also provides a general form of container comprising multiple panels that have been adhesively secured together, which carton can be employed in areas where gaseous control is required.

The present invention can thus provide a simple to use solution, for the preparation of a receptacle for use in a cold chain transport system that is easy to make and is less susceptible to permitting gaseous escape between the insulation panels.

BRIEF DESCRIPTION OF THE FIGURES

For a better understanding of the present invention, reference will now be made, by way of example only, to the Figures as shown in the accompanying drawing sheets, wherein:—

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

Figure 1:
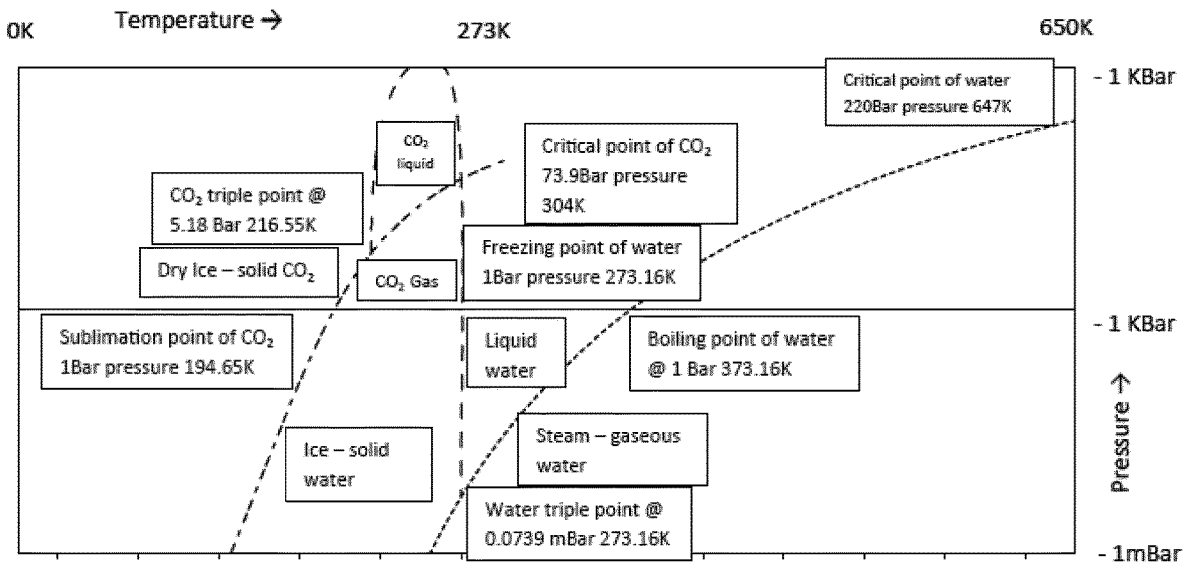
FIG. 1 shows phase change diagrams for carbon dioxide and water.
Figure 2A:
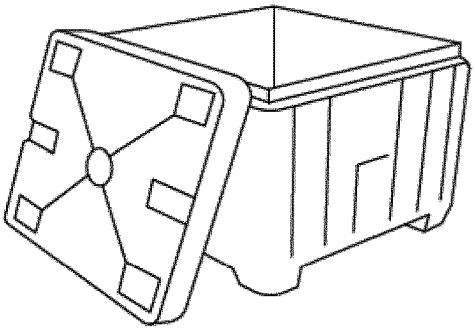
FIGS. 2*a* and 2*b*, illustrate two prior forms of plastics moulded ultra low temperature containers.
Figure 2B:
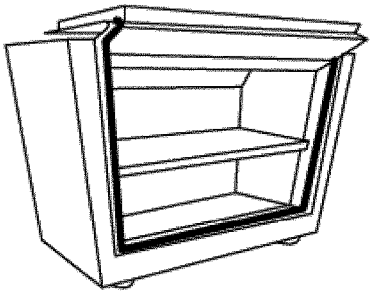
Figure 3A:
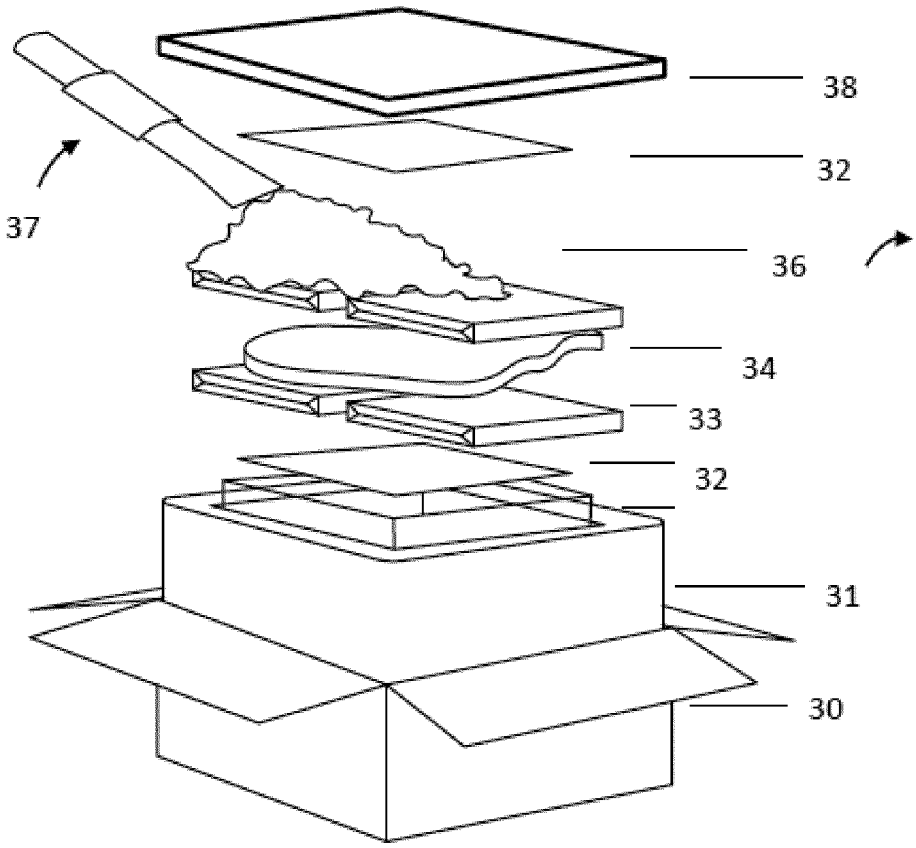
FIGS. 3*a* and 3*b* shows a prior form of cardboard cold chain carton.
Figure 3B:
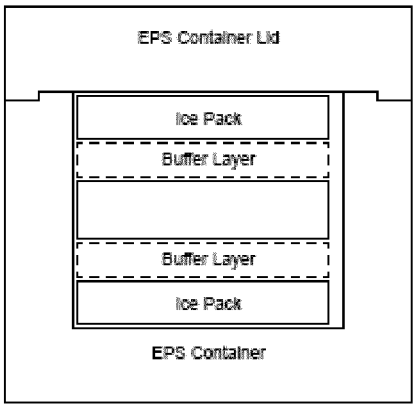
Figure 4A:
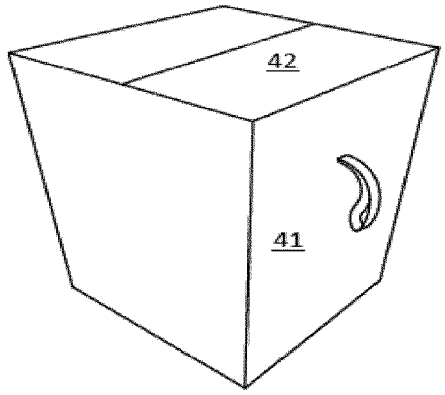
FIG. 4*a* shows a completed container in accordance with the present invention.
Figure 4B:
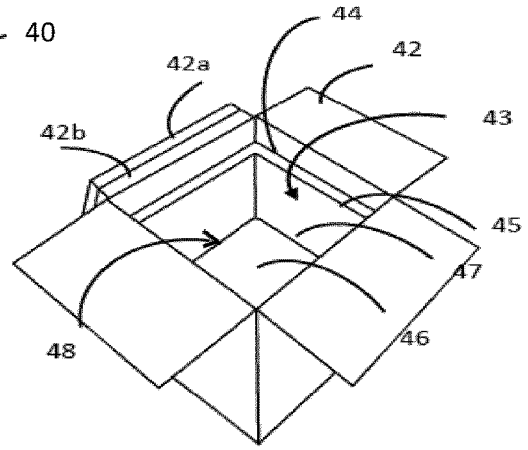
FIGS. 4*b* and 4*c* shows the main components in perspective view of the container with the cover elements raised and with insert box in position.
Figure 4C:
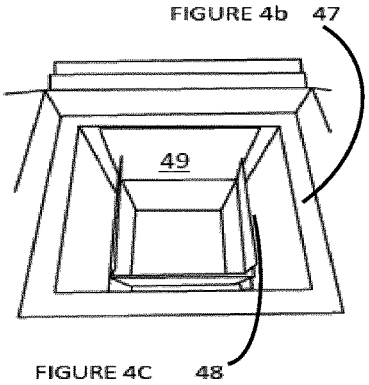

FIG. 4*a* shows a perspective view of an external view of a carton 40 in accordance with the field of the invention. A typical size for such a carton is 400×400×450 mm and is suitable for supporting a load of up to 12I (when arranged for ultra low temperatures). Logistics/end user information is conveniently displayed upon the external walls, with electronic data trackers being placed inside and typically providing radio frequency communications with data readers. FIG. 4*b* shows a first perspective view of the carton 40 in an open state, with cover flaps 42 depending from sidewalls 41. In particular, the inside volume 43 with base 46 defines a coolant and payload volume, into which an interior payload container is to be placed per reference arrow, and includes a number of elements, including insulation panels 44, which surround the coolant and payload volume. Conveniently, the insulation panels 44 comprise vacuum insulation panels (VIP) as are known and widely used in the cold chain industry. Foamed silica VIP panels provide a thermal conductivity benefit of the order of five with respect to polystyrene panels. However, these VIP panels can be easily damaged and so it is preferably provided with a protective material, for example, a panel of e-flute cardboard 45, having a thickness of 2 mm, which provides simple and adequate protection. Conveniently, the VIP panels are contiguously arranged together whereby, once installed within the external, four sided carton, there are only four non-contiguous edges as between each adjacent pair of edges of the five panels, with such panels being secured with, for multiple portions of so-called "sticky-back plastics tape" (not indicated) so as not to compromise heat sealing efficacy by reason of a passage of air between such adjacent pair of non-contiguously arranged VIP panels. The tape is conveniently reinforced with fibre, as is known, such as glass fibre, Kevlar and the like. In this carton 40, per FIG. 4*c*, sleeve element 47 defines the actual payload area and simply provides a sleeve into which vial cartons can be placed, as are frequently employed in ultra low temperature vaccine and medicament supply. Vials are small plastics or glass containers—analogous to truncated test-tubes—each vial being provided with a secured lid. Dry ice can be decanted by way of a dispenser with a nozzle as is shown in FIG. 3*a*. FIG. 4*c*, indicates a load volume 49 defined by interior load container 48. In this configuration dry ice can remain in close proximity to the payload, which may comprise, for example, vials within cardboard box containers. As discussed above, not only are the individual insulation panels time consuming to install, they are prone to failure through incorrect application and out gassing, for example.

Figure 5:
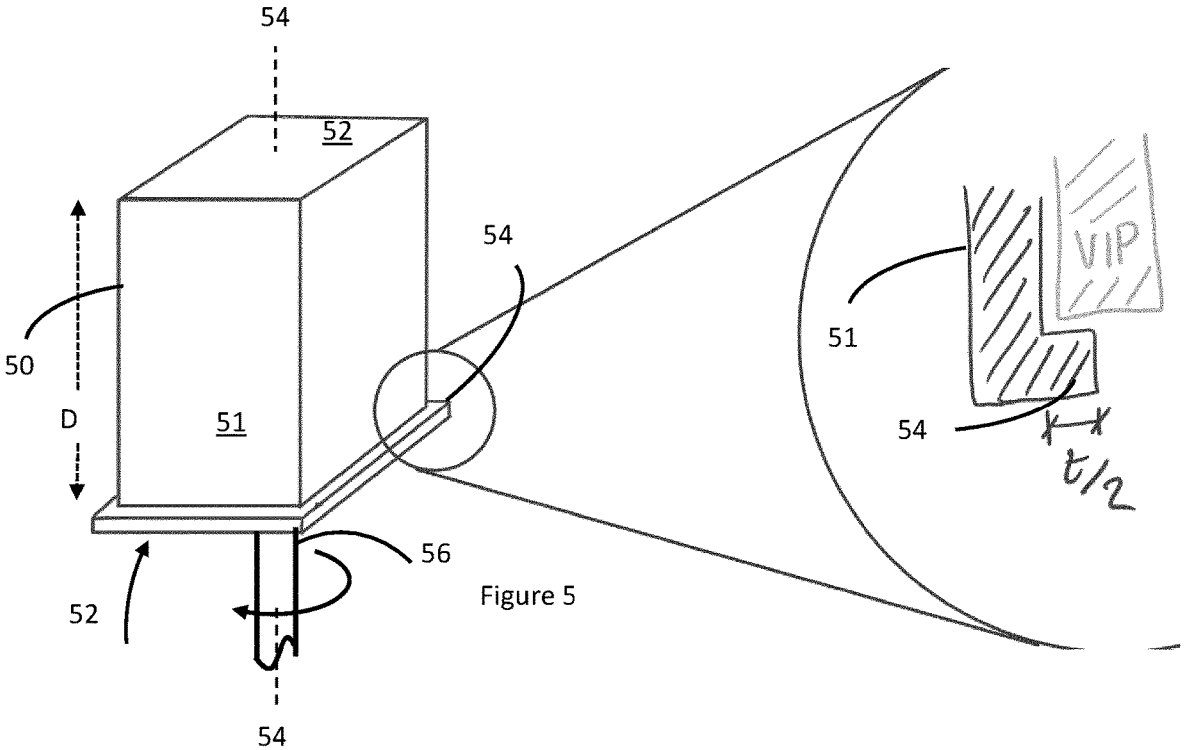
FIG. 5 shows an example of a rotatable former or mandrel in accordance with the present invention, with a detail in relation to a VIP panel.

In order to seek to overcome the issues of failure of multiple tape fastenings, Applicant has devised a mandrel-like support for the individual placement of insulation panels, to enable fastening thereof prior to placement within a container, such as a cardboard or plastics corrugated shipping container. With reference to FIG. 5, a rotatable former or mandrel 50 is shown, the mandrel comprising a five sided cube/cubic/cuboid box-like arrangement, having four retaining sides 51 and a top 52, with a base 53 extending with a ledge 54 and is conveniently adapted for rotation about an axis 55 in correspondence with a central axis of the general box shape frame, with a rotatable support 56. The retaining sides comprise a planar element in a size in correspondence with the VIP panels 44 and to support the same in assembly, the planar elements 51 having a length D from the upper side of the ledge 54 to the about the axis in correspondence with the height of the panels (when assembled in use as a insulation liner within a carton), with a width in correspondence with an associated panel—noting that the mandrel is shown as being of a general rectangular shape but could, of course be square or other shapes, but the rectangular form is typically employed for convenience in construction and packaging in the transport industry. However, for a non-equal-sided box—i.e. not being square in plan, the mandrel would need to have its planar elements of a corresponding size. The inset shows how a VIP panel can be placed upon the upper side of the ledge 53, with the ledge extending from the surface of the mandrel side by a distance being approximately half the thickness of the VIP panel, which has been found to facilitate placement in use.

Figure 5A:
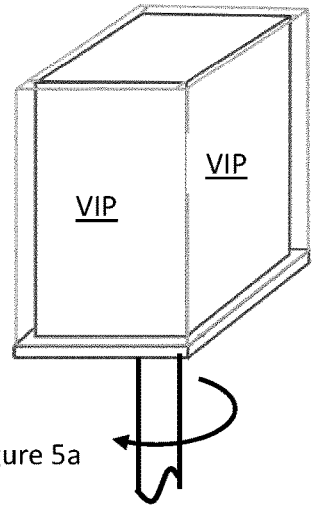
FIGS. 5*a*-5*c* show the steps in positioning and fastening insulation panels about a rotatable former or mandrel.
Figure 5B:
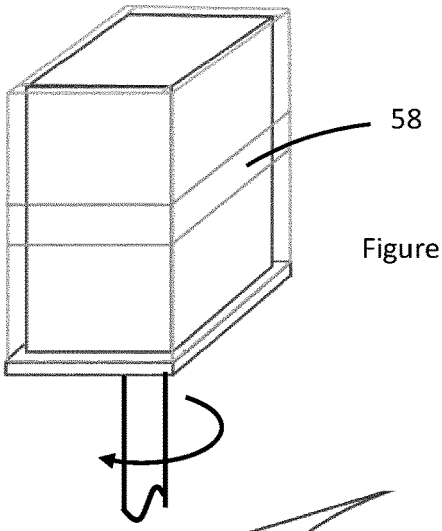
Figure 5C:
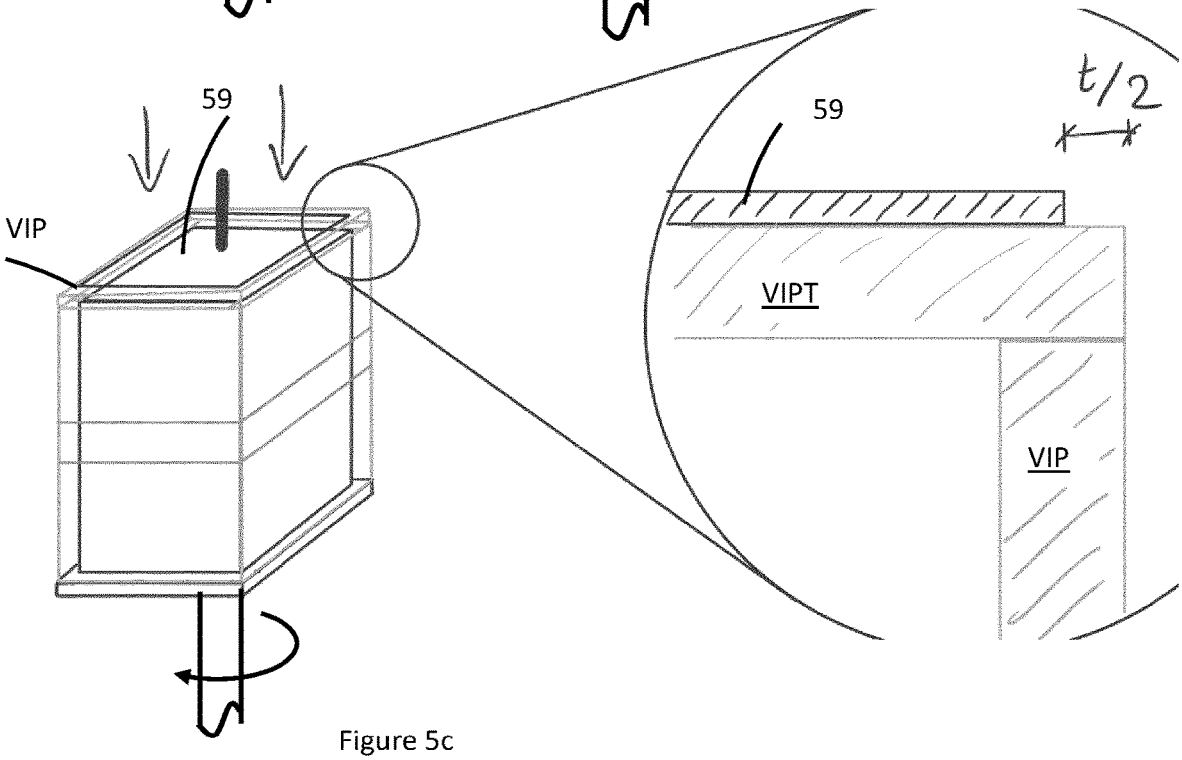

FIG. 5*a* shows the rotatable former or mandrel 50 with four panels, such as VIP panels, placed about the rectangular side panels of the mandrel. Vacuum assistance may be provided to assist in ensuring a correct position of the VIP panels upon the mandrel, although, with reference to FIG. 5*b*, the panels about the mandrel could be positioned by the use of an adhesive tape, which is wrapped around the four upstanding panels. More than one tape may be employed in the initial positioning step. With reference to FIG. 5*c*, a top panel VIPT is placed upon the rotatable former or mandrel such that the lower edges of the underside of the VIPT panel abut the upstanding side edges of the vertically oriented panels VIP. A positioning element 59 ensures that abutment occurs, noting that the application of too great a force could damage the panels and a sensor system is utilized to ensure that foreign bodies are not present, prior to the closing of the positioning element upon the horizontal VIPT panel. With reference to the inset section of FIG. 5*c*, in a similar fashion to the base, the positioning panel extends by approximately half the thickness of the upstanding panel VIP, to ensure that the horizontal panel is in contact with the upstanding edges of the panels VIP.

Figure 6A:
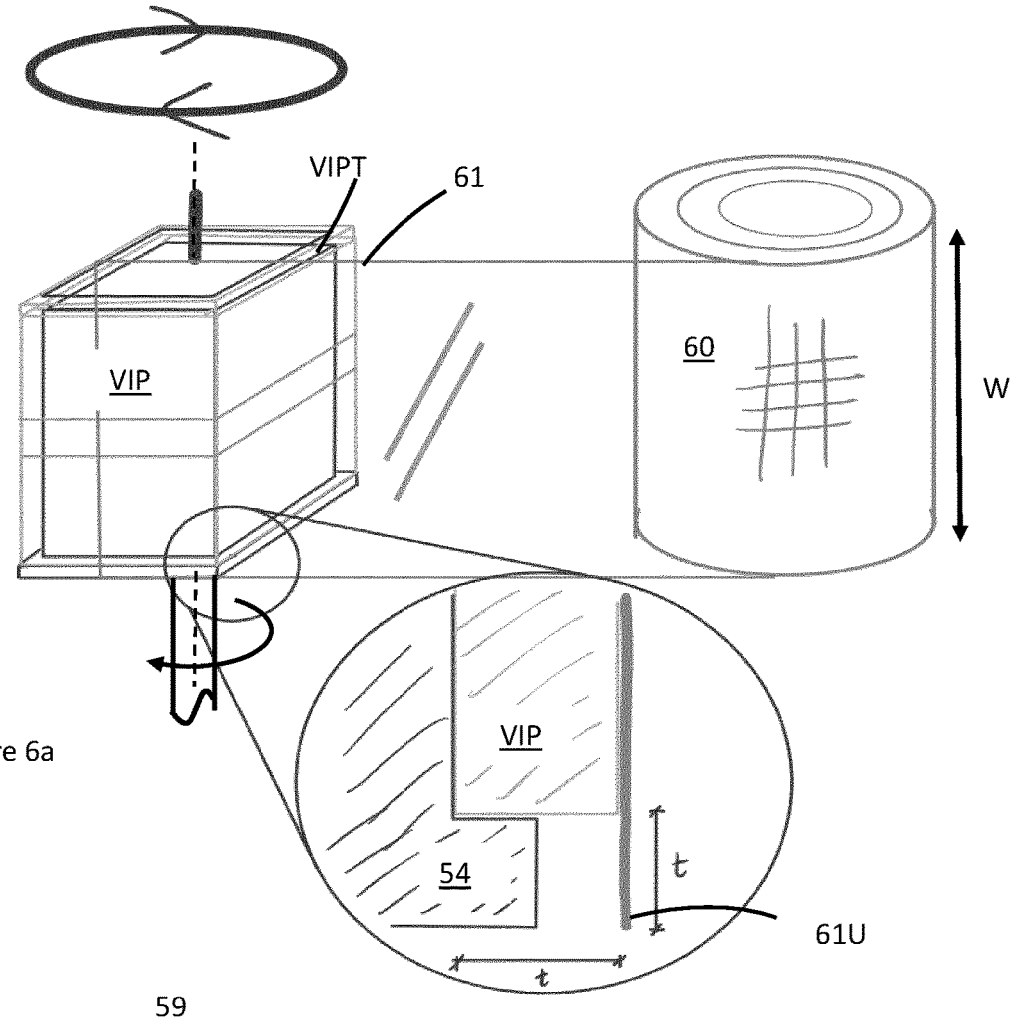
FIGS. 6*a*-6*b* show how the procedures in relation to the securement of insulation panels are performed.

Referring now to FIG. 6*a*, a roll 60 of single-sided adhesive tape 61 is shown, having a width of roll W which conveniently corresponds in length to the height of the upstanding panel plus three times the thickness of the VIP/VIPT panels—although the length of the tape can correspond to the height of the panel plus 25 mm, in order for the tape to be securely fastened, as will be realized by the skilled man, noting that the stiffer a tape is then the greater the adhesive amount of upstanding tape is required to enable the folded portion to remain in place. This enables the tape

Figure 6B:
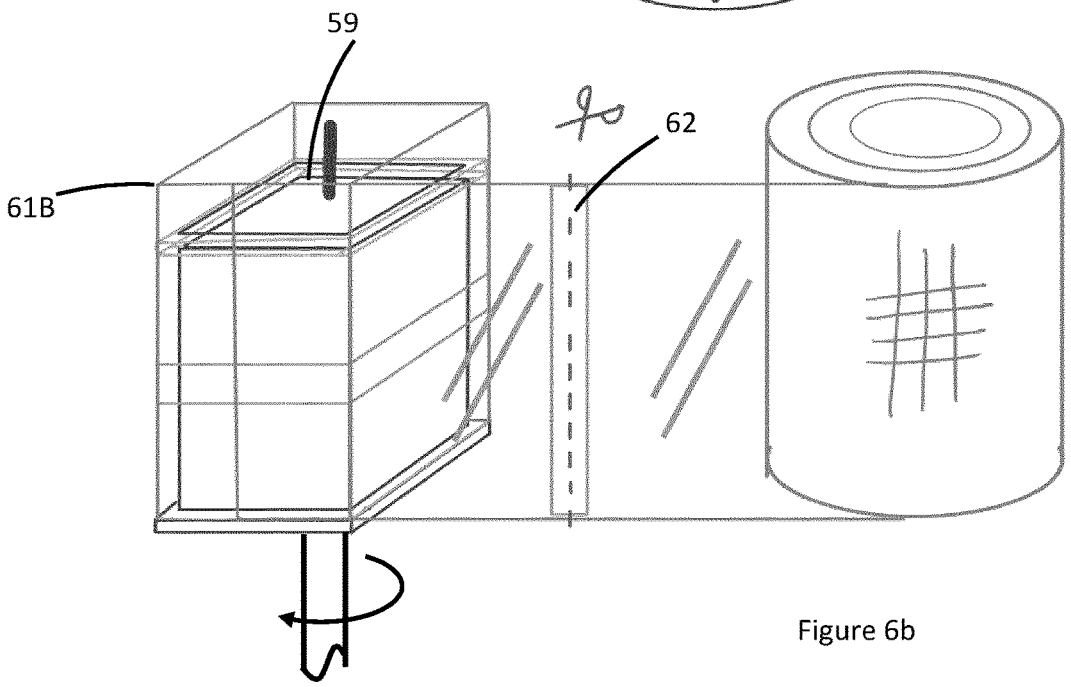

61 to extend so that at the lower part, upon the rotatable former or mandrel as depicted, the tape extends 61U in correspondence with the thickness of the VIP panel—as seen in the inset part of the diagram- and, at the upper part, upon the mandrel, the tape extends 61B in correspondence at least twice the VIPT panel thickness such that the tape extend such that it can be folded upon and adhesively attaches to at least the edge portion of the upper surface (as per figure: the container defined by the rotatable former or mandrel is shown as being produced in an inverted fashion, as would be apparent to the skilled person). It will be appreciated, that the dispensing of tape could be performed by two (or more) rolls of tape each having a width less than the height of the panel to be secured but the two rolls are arranged to provide a total width in correspondence with a desired width of adhesive tape. FIG. 6*b* shows the same arrangement as FIG. 6*a* save that the rotatable former or mandrel has rotated by one turn such that the tape has now been applied about the four VIP panels and the tape is then cut along perforations 62 after a sufficient overlap has been provided. Pressure sensitive adhesives (PSAs) are adhesives that are permanently tacky and will stick to a variety of surfaces under light pressure.

A source of heat such as the use of a hot air gun (not shown), or other substantially inert gas, may be applied to heat the tape and the adhesive to assist adhesion. The adhesive tape need not have a tremendous degree of strength in its bond, given that the tape contacts a large planar surface; indeed it is helpful, for maintenance that the tape be easily removable. Adhesive tack is the property of an adhesive that enables it to instantly form a bond when brought into contact with another surface (which may be another adhesive). Adhesive tack tends to be a more variable property than other properties of an adhesive since it depends on so many different factors. Control of tack is important in operations where instant bond strength is needed. However, in many assembly or packaging applications tack strengths may need to be limited to allow separation and refitting of parts. Adhesive tack depends on the adhesion between the adhesive and the surface and the cohesive strength of the adhesive. Tack properties are thought to depend on the visco-elastic characteristics of the polymer adhesives. Good adhesive tack is normally achieved when the adhesion strength is greater than the cohesive strength of the adhesive (or the substrate).

Inventors note, however, that in order to provide serviceability, the adhesive properties could be easily removable—sometimes known as "clean peel" adhesive. Although typical characteristics at STP cannot be guaranteed for applications where product would remain at temperatures in the region of −90° C.-60° C., inventors realized positive results during tests. Moreover, and as alluded to above, the folding of a "clean peel" adhesive tape will require a greater degree of tape to extend and to be folded down, since a "clean peel" tape necessarily has a reduced degree of tack.

Figure 6C:
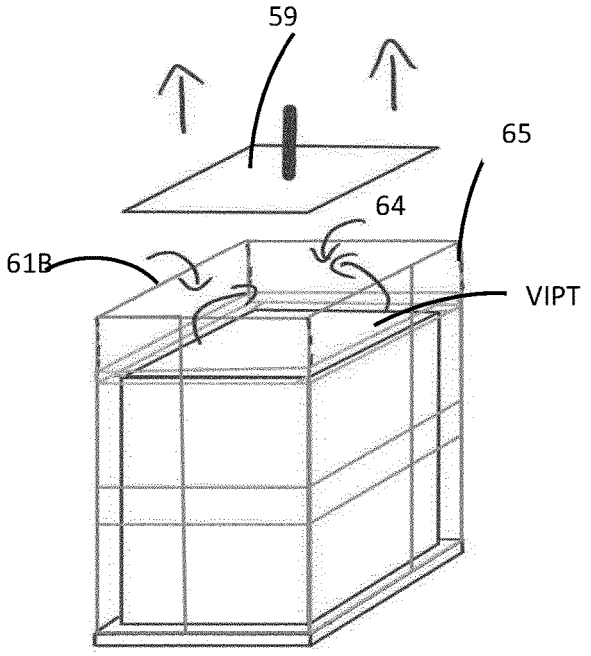
FIGS. 6*c*-6*d* show how the procedures in relation to the securement of a base insulation panel are performed.
Figure 6D:
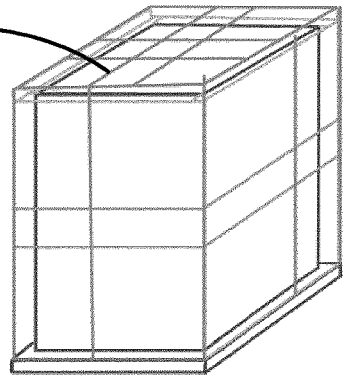

Referring now to FIG. 6*c*, once the side edges of the upper panel VIPT to the adhesive tape 61 and the vertical panels VIP, the positioning plate 59 is removed, followed by the remaining upstanding tape 61B being folded over 64, conveniently having slits 65 made in the corners to assist the folding. Again, heating with the use of a hot air gun or similar may be helpful. An additional layer of film can be placed upon the base, whereby to assist in in the prevention of lifting of the folded perimeter portions of tape.

Figure 7:
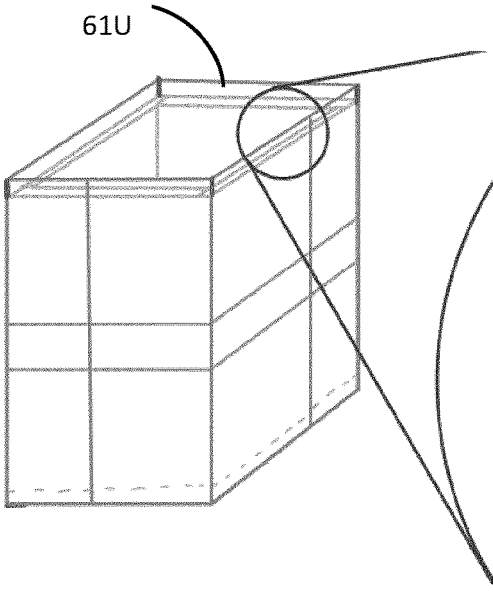
FIGS. 7*a*-7*ii* show procedures in relation to the finishing of the aperture of the container.
Figure 7I:
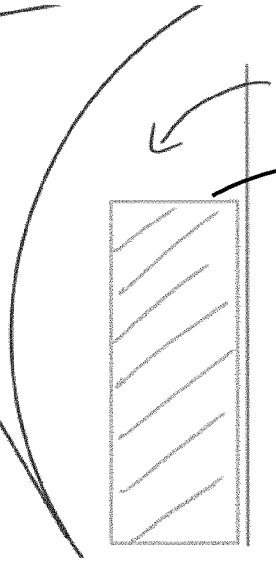
Figure 7I:
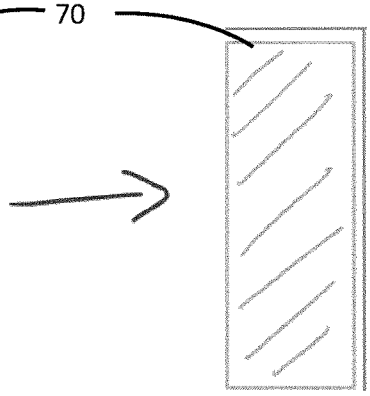

In the next step of fabrication, the carton is removed from the mandrel and turned into an upright orientation as shown in FIG. 7. Tape edges 61U extend upwardly. In a similar fashion to the manner of folding over the opposite edges 61B, the tape edges 61U associated with an upper lip 70 of the container are folded over with respect to the inset views 7*i* and 7*ii*.

Figure 8:
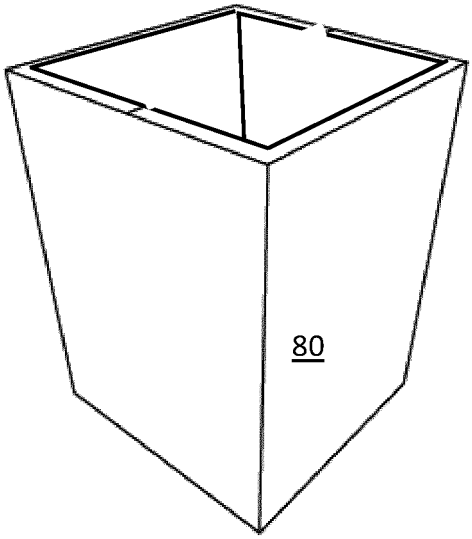
FIGS. 8*a*-8*c* show how the assembly may be arranged and prepared for transport.
FIGS. 8*d* & 8*e* show graphical results of an increase in performance of cartons in accordance with the present invention; and, FIGS. 9*a*-9*b* show aspects of a step in method of fabrication of a carton.
Figure 8B:
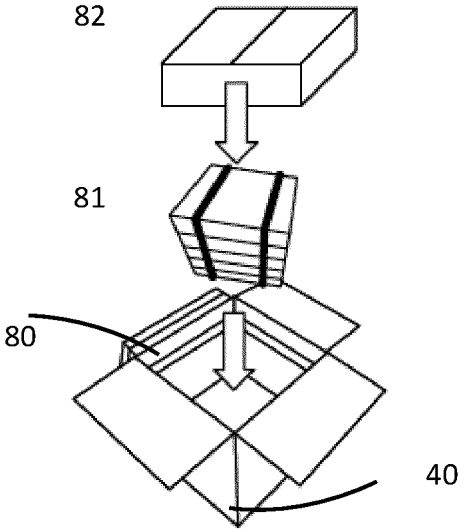
Figure 8C:
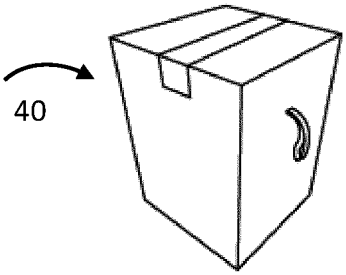
Figure 8E:
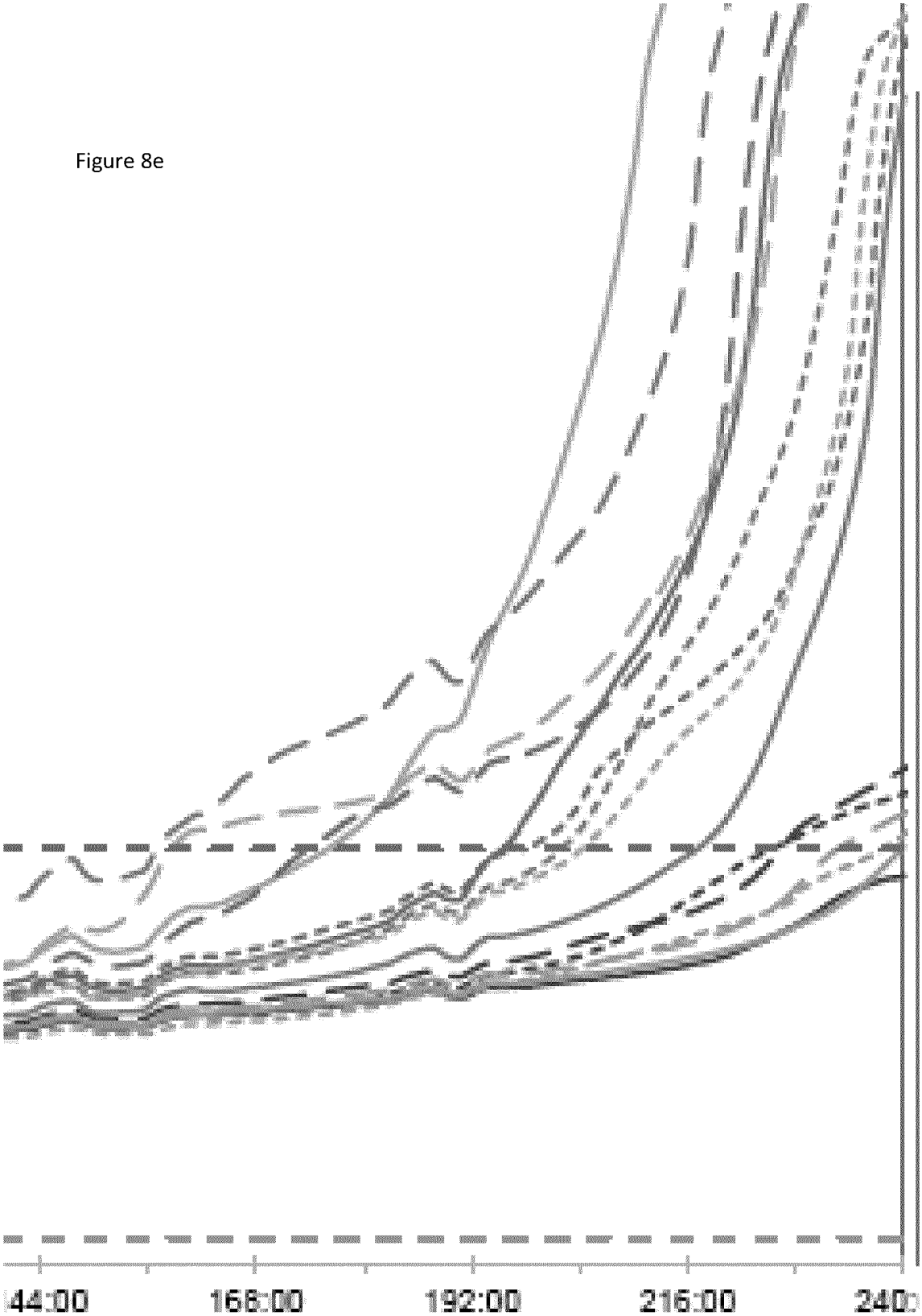

FIG. 8 shows a completed insulation container 80 and in FIG. 8*b* the insulation carton 80 is inserted into an external carton 40, after which, firstly, the product 81 is placed followed by any coolant or spacing material 82. A lid comprising a vacuum insulation panel is then placed onto in a close-contacting fashion with the upper lips 70 of the side panels of carton 80, noting that there will typically be a positive pressure within the internal volume arising from the sublimation of dry ice and similar coolants and an off-gassing pressure release system may be necessary. Once a VIP lid and any further spacing have been placed within the carton 40, the carton is secured, conveniently with adhesive tape. It will be noted that it has been found that by applying the tape with a degree of tension, it is ensured that the insulation panels closely abut one another upon rotation of the mandrel.

The particular tape employed needs to be operable at low temperatures and it has been found that polypropylene tapes can be used at low temperatures, especially when reinforced by fibre/mesh. Whilst it seems that tape manufacturers such as Intertape Polymer Group and 3M does not recommend the use of their low temperature tapes inventors have determined, that, nonetheless e.g. 3M VHB tapes have fared reasonably well in exceedingly cold temperatures. It is also possible to use shrink wrap tapes—commonly employed for retaining goods on a pallet; the films are stretched and then heated to tauten the wrap and secure the panels. Other types of tape can also be used such as mono-oriented polypropylene (MOPP) film, which is a film which has an ability to stretch in a direction of application. It has been found that tape with reinforcement fibres can assist in the integrity of a tape, such as by the use of glass-fibre reinforcement. The fibres assist in the maintenance procedures, since, when using a low adhesive bond the tapes can be removed, when replacing, for example one or two damaged insulation panels. Inventors have found that a range of formulations of silicone, rubber and acrylic adhesives can be employed and are known form applications such as re-sealable food packaging, powder coat paint masking, glazing, touch screens etc. It will be appreciated that latent residue could change the dynamic of any subsequent wraps that will arise in maintenance issues. It is known that typical widths of such films available in practice range from a couple of centimetres to a couple of meters, which is sufficient for the intended use of fastening insulation panels. During development, it was also noted that several tapes would tend to delaminate—i.e. a tape could not be completely be removed, which might affect intended performance or ability to be processed in a remanufacturing process.

The present invention has been deployed primarily to secure vacuum insulation panels which are quite fragile and provide extremely good thermal characteristics, especially under low temperature conditions, given that there is an elimination of draughts that would otherwise occur. This may be considered as, ordinarily speaking, rather insignificant. However, given that the temperature delta ranges that will be typically of the order 70-110K with respect to ambient, together with the off-gassing of dry ice, the effect of the present invention is significant. Applicants have found that the panels effectively eliminate the passage of gas between the panels. The adhesive types are selected to provide a simplicity of application with an ability to be easily removed when required so that damage to one or two panels does not require the replacement of a five-sided carton. Notwithstanding this, it has been found that the techniques employed with respect to panels such as vacuum insulation panels but also to other forms of panel, where ordinary folding techniques, as traditionally employed in cardboard box manufacture, for example. As discussed above, folds can lead to breakage of the board leading to the creation of cracks and fissures leading to air passages within the material, leading to gas flow therefrom and thus making such containers less useful, especially in cold chain transport applications. Indeed, thicker cardboard, notably multi-layer corrugated board (such as the so-called tri-wall quad-wall etc. corrugated board) and can have edges mitred to enable close fit between panels and then be adhesively fastened. The base panel can also have edges abutting the side panels mitred, with the sidewalls correspondingly mitred with respect the base panel, which, incidentally also may assist assembly techniques, with the apparatus necessarily being adapted to enable this to happen.

It will be appreciated that cold chain cartons need to be comply with industry standard requirements as defined by the International Safe Transit Association (ISTA) which is a global alliance of shippers, carriers, suppliers, testing laboratories, and educational and research institutions focused on the specific concerns of transport packaging. In particular, ISTA provides a drop test ISTA 3A, which address the integrity of boxes and cartons for freight; the ISTA 3A testing procedure is a general simulation test for individual product packages sent via a package delivery service such as UPS, DHL, FedEx, etc., whether by air or land. ISTA specifies that the 3A testing procedure covers the testing of individually packaged products weighing not more than 70 kilograms (150 pounds) when prepared for shipping via a package transport company. FIG. 8*d* shows results in the form of a graph with respect to results of a drop test with regard to the thermal performance over time compared with two examples of cartons manufactured in accordance with the present invention. The tests have been referenced with respect to partial and full drop tests.

Figure 9A:
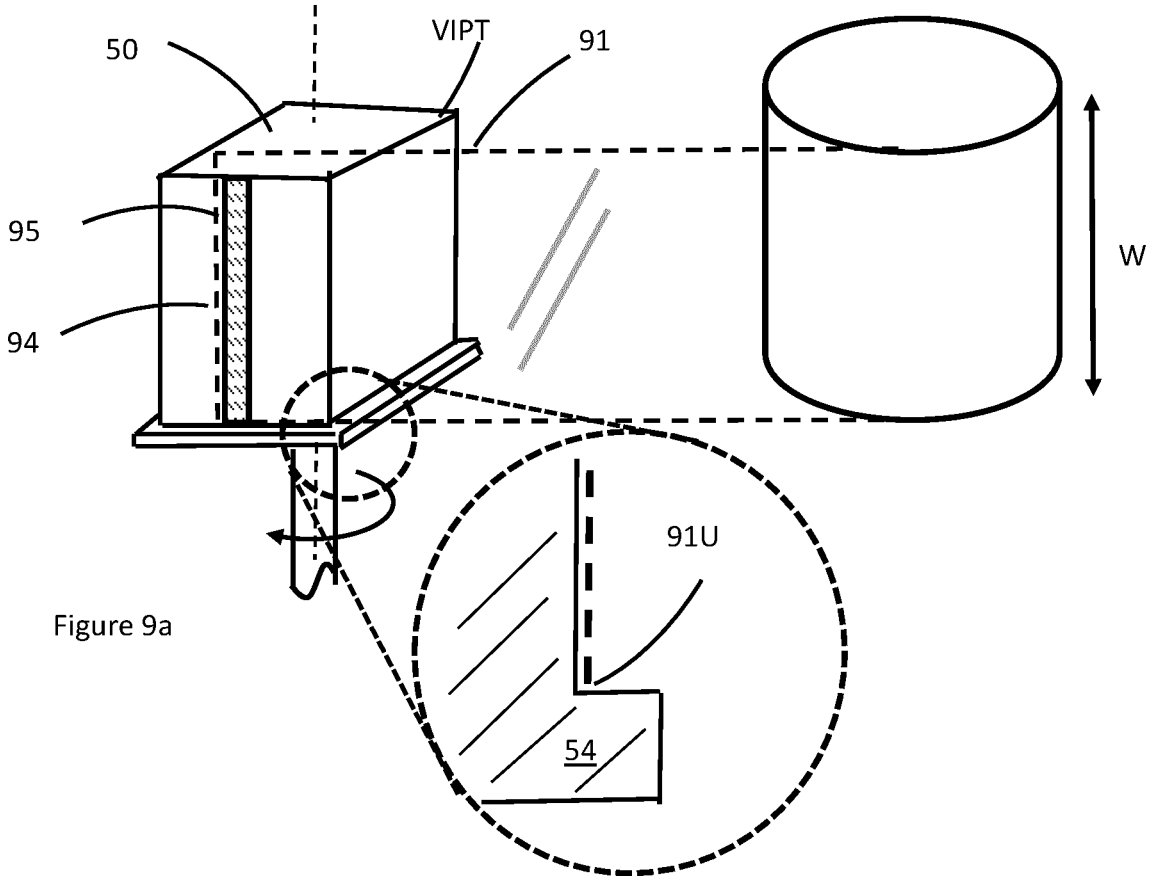
Figure 9B:
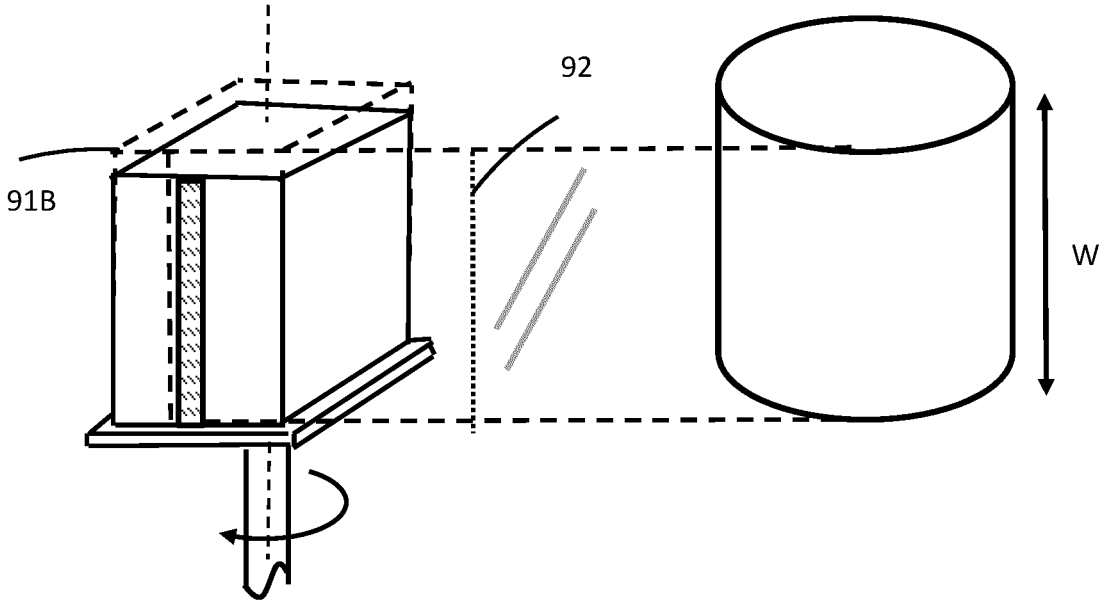

In accordance with another aspect of the invention, there is provided a further variant in the method of fabrication, as shall now be discussed with reference to FIGS. 9*a* and 9*b*. In this method, a first layer of adhesive tape 91 is attached to the rotatable former or mandrel 50, with the adhesive layer being on a side of the tape directed away from the rotatable former, necessitating the use of a low-tack adhesive pad 95 associated with the mandrel and for placement of a leading edge 94 of the tape, whereby the tape can be secured during assembly. The pad 95 is conveniently capable of being separated from the surface of the rotatable former, to enable a removal of the assembly once manufactured. In the alternative, a mechanical grip element could be used, whereby a mechanical grip can be easily released upon removal of the finished assembly. Equally, low tack double sided tape could be employed to enable placement of the leading edge 94 of the tape 91. With reference to the inset portion, it will be seen that the lower edge of the tape 91U is placed such that it is brought to the ledge element 54 of the rotatable former. The rotatable former is then rotated, and as shown in FIG. 9*b*, the adhesive tape 91 fully surrounds the rotatable former such that once aligned, insulation panels can be affixed thereto, noting that the placement of insulation panels, whether VIP or other types of panel must be carefully aligned. It will be appreciated that this is followed by a cutting of the tape along line 92 and a placement of the upper part of the tape 91B transversely with respect to the sidewalls, on surface 52 of the mandrel. The corner sections could be sequentially cut and folded whereby the outer adhesive film of a corner section is employed to secure the underside of the adjacent adhesive film, which is performed for the sequential corners. In the alternative, as with the side elements, a low-tack pad could additionally be provided or a separate low-tack double-sided adhesive tape. An additional layer of tape could be provided, in correspondence with the surface 52 of the mandrel.

The present invention permits a simple method of fabrication of a leak-proof insulation container, using simple and readily available adhesives: In view of the use of the material, it has been found to be simple to replace one or more insulation panels in the event of damage through mishandling or otherwise. Whilst it is possible to remove adhesive and tape, Applicants have determined that this is not absolutely necessary and that the tolerance so packaging permit one or more layers of tape to be employed as will necessarily arise in use. Whilst specific reference has been made to vacuum insulation panels, which are typically relatively brittle and more susceptible to damage, the technique can be applied to other types of insulation panel such as expanded polystyrene. Moreover the present invention provides a benefit in performance together with a benefit in reducing waste, since separate panels can be replaced rather than the inside carton of a cold chain transport product. It has also been found that the use of tape in conjunction with the sidewall material of vacuum insulation panels has reduced degradation of the panels though gas permeation.

It will be appreciated by those skilled in the art that variations can simply be applied. For example, where the height of a box is greater than the width of available roll of tape, two (or more) tapes could be applied in parallel fashion, with degree of overlap to ensure sealing is effected over the height of the box and the join with the base panel. Non-adhesive tape may be employed and adhesive may be applied by spray to either a tap or a surface to which the tape is applied. Once the arrangement of panels have been secured together by means of the tape surrounding the panels, whereby there are no gaps at the edges between adjacent panels, the section of film extending perpendicularly to the base panel 44, can be folded toward the base panel to secure the arrangement externally.

The present invention thus allows for a simple fabrication of a receptacle having extremely high thermal insulation qualities, providing elements that can be used not only in standard cold chain logistics containers and cartons abut also in ultra low temperature containers where the operating temperature can be less than −80° C.

The invention claimed is:

1. A method of providing an insulating carton for use in a cubic cold-chain container, the insulating carton being formed of four lateral insulating panels about an axis, together with a base insulating panel arranged orthogonally to the axis, with each insulating panel having four edges, with respective adjacent panel edges mutually abutting, the carton having side walls with mutually orthogonal first and second parallel edges of first and second lengths (L1 and L2) with the side panels extending a depth (D) to the base, the panels having a thickness (T); the method comprising:

selecting a cubic former for the insulating carton, having external dimensions in correspondence with the dimensions of an interior cavity of the insulating carton;

placing the panels about the former, whereby an inside face of each panel is directed towards a corresponding outside face of the former and an external face of each panel is directed away from the axis;

applying adhesive tape about the external faces of the panels, the adhesive tape having a width greater than the depth of the side panels; and folding the adhesive tape extending from the sides towards the base, to secure the side panels to the base.

2. The method of claim 1, wherein the method further comprises the step of folding any of the adhesive tape extending from an open end of the container about an edge of the side panels.

3. The method of claim 1, wherein the mandrel is arranged for rotation about an axis in correspondence with a central axis of the carton and the mandrel is rotated as the tape is applied.

4. The method of claim 1, wherein the step of applying adhesive tape about the external faces of the panels, is enabled by the application of first and second tapes provided such that there is an overlap between said first and second adhesives tapes, the second adhesive tape being applied subsequently to an application of the first adhesive tape.

5. The method of claim 1, wherein the insulation panels are selected from one of the following: vacuum insulation panels; expanded polystyrene panels, polyurethane panels, panels of card, panels of plastics card, panels of board, panels of corrugated plastics, panels of cardboard and panels of corrugated cardboard.

6. The method of claim 1, wherein the first and second panels have a width of the same length.

7. The method of claim 1, wherein applying the adhesive tape further comprises applying the adhesive tape from a single roll having the width that is greater than the depth of the side panels.

8. The method of claim 1, wherein applying the adhesive tape further comprises applying multiple layers of the adhesive tape about the external faces of the panels.

9. The method of claim 1, further comprising:

positioning a positioning plate adjacent to the base prior to the act of applying adhesive tape; and removing the positioning plate prior to the act of folding the adhesive tape extending from the sides towards the base.

10. A method of providing an insulating carton for use in a cubic cold-chain container, the insulating carton being formed of four lateral insulating panels about an axis, together with a base insulating panel arranged orthogonally to the axis, with each insulating panel having four edges, with respective adjacent panel edges mutually abutting, the carton having side walls with mutually orthogonal first and second parallel edges of first and second lengths (L1 and L2) with the side panels extending a depth (D) to the base, the panels having a thickness (T); the method comprising:

selecting a cubic former for the insulating carton, having external dimensions in correspondence with the dimensions of an interior cavity of the insulating carton;

placing the panels about the former, whereby an inside face of each panel is directed towards a corresponding outside face of the former and an external face of each panel is directed away from the axis;

applying a first adhesive tape about a first portion of the external faces of the panels;

applying a second adhesive tape about a second portion of the external faces of the panels such that there is an overlap between said first and second adhesive tapes so that the first and second adhesive tapes collectively have a width greater that the depth of the side panels; and folding the first and second adhesive tapes extending from the sides towards the base, to secure the side panels to the base.

11. The method of claim 10, the second adhesive tape being applied subsequently to the application of the first adhesive tape.

12. The method of claim 10, the second adhesive tape being applied at the same time as the application of the first adhesive tape.

13. The method of claim 10, wherein the method further comprises the step of folding any tape extending from an open end of the container about an edge of the side panels.

14. The method of claim 10, wherein the mandrel is arranged for rotation about an axis in correspondence with a central axis of the carton and the mandrel is rotated as the tape is applied.

15. The method of claim 10, wherein the insulation panels are selected from one of the following: vacuum insulation panels; expanded polystyrene panels, polyurethane panels, panels of card, panels of plastics card, panels of board, panels of corrugated plastics, panels of cardboard and panels of corrugated cardboard.

16. The method of claim 10, wherein the first and second panels have a width of the same length.

17. A method of providing an insulating carton for use in a cubic cold-chain container, the insulating carton being formed of four lateral insulating panels about an axis, together with a base insulating panel arranged orthogonally to the axis, with each vacuum insulating panel having four edges, the carton having side walls with mutually orthogonal first and second parallel edges of first and second lengths (L1 and L2) with the side panels extending a depth (D) to the base, the method comprising:

selecting a cubic former for the insulating carton, having external dimensions in correspondence with the dimensions of an interior cavity of the insulating carton;

placing the vacuum insulation panels about the former, whereby an inside face of each panel is directed towards a corresponding outside face of the former and an external face of each panel is directed away from the axis;

applying adhesive tape about the external faces of the vacuum insulation panels, the adhesive tape having a width greater than the depth of the side panels; and folding the adhesive tape extending from the sides towards the base, to secure the side panels to the base.

18. The method of claim 17, wherein applying the adhesive tape further comprises applying multiple layers of the adhesive tape about the external faces of the panels.

19. The method of claim 17, further comprising:

positioning a positioning plate adjacent to the base prior to the act of applying adhesive tape; and removing the positioning plate prior to the act of folding the adhesive tape extending from the sides towards the base.

* * * * *